United States Patent [19]

Lashyro et al.

[11] Patent Number: 5,036,644

[45] Date of Patent: Aug. 6, 1991

[54] PACKAGING SLEEVER ASSEMBLY

[75] Inventors: Jeffrey A. Lashyro; Gerald O. Irvine, both of Crosby, Minn.

[73] Assignee: Minnesota Automation, Inc., Crosby, Minn.

[21] Appl. No.: 427,453

[22] Filed: Oct. 26, 1989

[51] Int. Cl.[5] ..... B65B 11/10; B65B 21/24; B65B 35/44

[52] U.S. Cl. ..... 53/398; 53/48.1; 53/387.1; 53/448; 53/543; 53/590

[58] Field of Search ..... 53/48, 49, 285, 387, 53/388, 398, 443, 448, 543, 252, 590

[56] References Cited

U.S. PATENT DOCUMENTS

| | | | |
|---|---|---|---|
| 2,751,730 | 6/1956 | Gentry | 53/398 |
| 3,225,510 | 12/1965 | Jones et al. | 53/48 |
| 3,303,631 | 2/1967 | Ganz | 53/48 |
| 4,100,715 | 7/1978 | Ganz | 53/49 X |
| 4,501,104 | 2/1985 | Griffin et al. | 53/398 X |
| 4,530,686 | 7/1985 | Everson et al. | 493/431 X |
| 4,693,055 | 9/1987 | Olsen Jr. et al. | 53/48 X |
| 4,802,324 | 2/1989 | Everson | 53/48 X |

*Primary Examiner*—John Sipos

*Assistant Examiner*—Linda B. Johnson

*Attorney, Agent, or Firm*—Anthony G. Eggink; Joel D. Skinner

[57] ABSTRACT

A continuous packaging sleever assembly and process for wrapping packaging sleeves about product groups. The assembly has a frame structure with a generally horizontal working surface, a transfer conveyor to move the product containers across the working surface, and horizontally movable flight bar structures connected to a continuous chain structure. The flight bar structures are constructed and arranged to be selectively movable in a generally perpendicular direction to the product transfer conveyor means and to separate the product containers into predetermined groups. A packaging sleeve transfer and placement structure is provided in synchronization with the flight bar structures for depositing flat packaging sleeves between adjacent flight bar structures and above the product groups. The flight bar structures simultaneously move the product groups and the individual sleeves thereon. Product group wrapping and closing structures are provided to fold and secure the packaging sleeves in a tight configuration about the product groups.

21 Claims, 5 Drawing Sheets

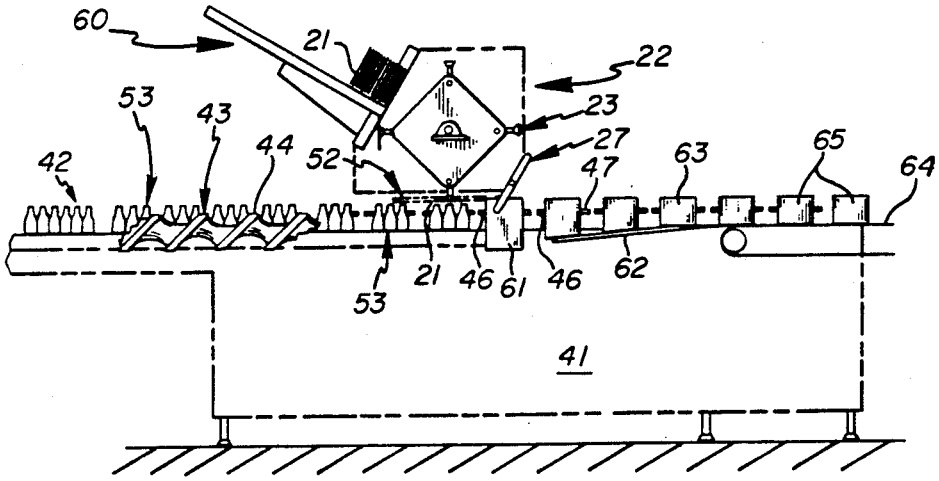
Fig. 8
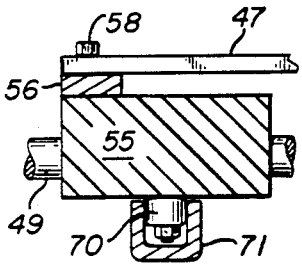
Fig. 11
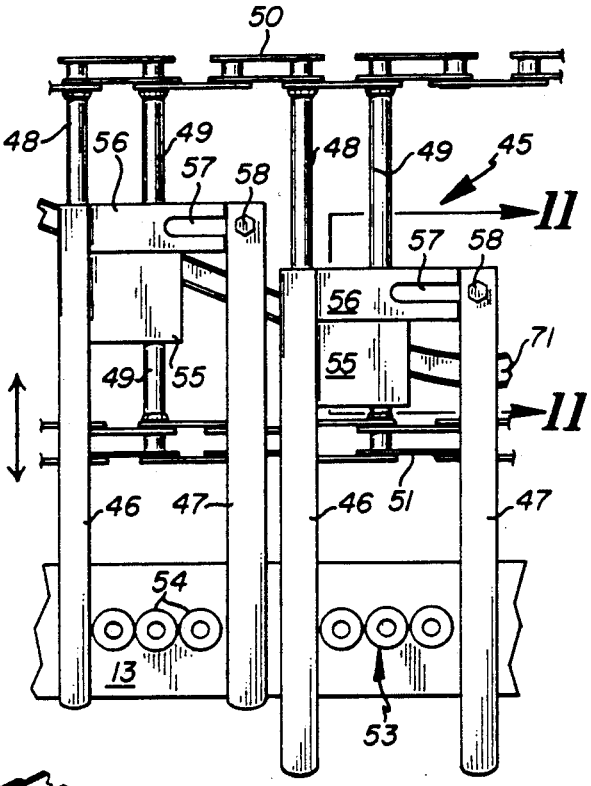
Fig. 9
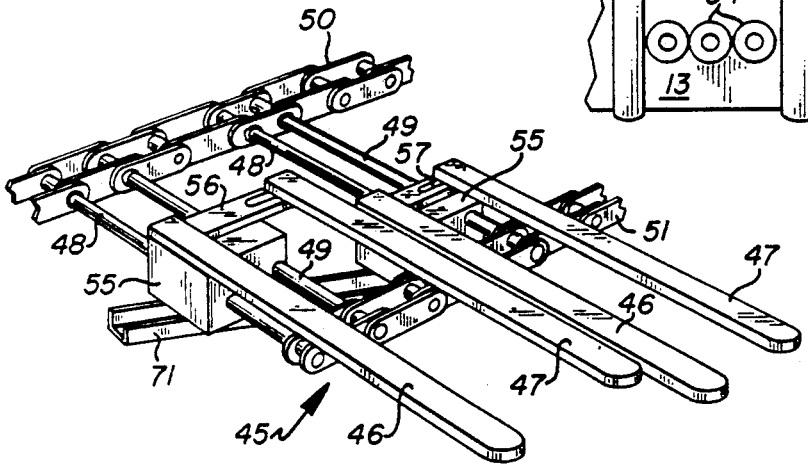

PACKAGING SLEEVER ASSEMBLY

BACKGROUND OF THE INVENTION

This invention relates to a machine assembly and process for wrapping packaging sleeves about product groups. Particularly, this invention relates to a packaging sleever assembly and process of packaging individual product groups from a continuous product stream. The assembly and process separates the product stream into product groups and wraps and secures packaging sleeves about the individual product groups.

Various machines and processes have been proposed and used to continuously package selected product groups. These machines and processes have typically comprised packaging machinery components and structures which separate the product stream into product groups, which provide a packaging structure, such as a sleeve, to each product group and which secures the packaging structure about the group to form finished units.

Each prior art machine and process, however, accomplishes the wrapping and securing of packaging structures about the product groups in its own particular manner and uses specific structures to preselect and separate the product groups. Particularly, the manner in which the packaging structures are placed with respect to the product groups and subsequently secured about them varies significantly. The machine structures and processes utilized, often are dictated by the size and configuration of the individual products, the desired product group size and, particularly, they depend upon the physical structure and configur,ation of the packaging structures to be utilized. Packaging speed, accuracy and economy being the hallmark for each machine structure and process.

For example, Applicant's assignee, as disclosed in U.S. Pat. Nos. 4,530,686, and 4,802,324, respectively, teach a Rotary Carton Placer and a vertical Cartoning Assembly and Method for use in the packaging of product groups. Patent '686 discloses a carton placer which operates by driving one or more planetary gear driven article transfer mechanisms about a stationary gear and which causes the vacuum cups, for example, to travel in rotational paths having apex or outward positions of travel. At these apex positions various cooperating structures can be positioned, such as an article storage magazine or a moving conveyor.

The '324 Patent discloses a vertical cartoner assembly and method for placing and assembling cartons over preselected product groups moved on a conveyor. In its operation, a rotary carton placer, as disclosed in the '686 Patent, is used to remove cartons in a flat and folded configuration from a storage magazine and placed and opened between the flight arms of the carton flights of the vertical cartoner structure. As the open and erected carton is moved in synchronization with and above the product groups being carried on the line conveyor, a cam structure causes the open carton to move downwardly and over a product group. In conjunction with a carton folding mechanism or gluing station, the carton is then folded or constructed into a wrapped confiquration to yield the completed packaged product. Thus, the process of the '324 invention is to vertically lower partially erected cartons onto the preselected moving product groups.

The packaging sleever assembly of this invention places sleeve structures onto selected and moving product groups in a different manner. The assembly comprises a frame structure, a product stream and a means to select product groups from the product stream. The assembly of this invention, in contrast to the prior art assemblies, transfers flat packaging sleeves from a magazine and places the sleeve structures onto the preselected groups. Thereafter, the packaging sleeves are wrapped and closed in synchronized movement. Thus, rather than lowering a partially constructed sleeve as disclosed in the '324 Patent, the assembly of this invention places flat packaging sleeves directly onto the selected product groups. The sleeves are held and moved simultaneously along with the product groups by flight structures which move in the direction of the product stream flow, but, which additionally move in a horizontal manner perpendicular to the stream flow.

SUMMARY OF THE INvENTION

This invention provides a continuous packaging sleever assembly for wrapping packaging sleeves onto and about groupings of product containers. The assembly has a frame structure with a generally horizontal working surface area, conveyance means to move the product containers across the working surface, and a product selecting and moving structure. The selecting and moving structure is comprised of a pair of continuous chains having slidable flight bar structures mounted therebetween. The flight bar structures are constructed and arranged to be selectively movable in a generally perpendicular direction to the product conveyance means and to separate the product containers into predetermined groups.

A packaging sleeve transfer and placement structure in synchronizion with the flight bar structures is provided for depositing flat packaging sleeves between adjacent flight bar structures and above the product groups. A rotary flap tucker is provided to move downward the sleeves placed above the product groups and which comprises spaced rotating vanes disposed above and on opposite sides of the product stream. Means to wrap and close the packaging sleeves about the product groups are further provided.

In one embodiment of the sleever assembly, the selecting and moving structure is comprised of an infeed screw mechanism to provide selected product groups and a cooperating continuous motion flight bar assembly having adjustable flight bars slideably engaged on a support bar structure. The support structure has elongated shafts mounted to parallel continuous chains.

Also provided in the packaging sleever assembly are flight bar configurations and associated cam track and cam follower structures to control the synchronized movement of the flight bar structures with respect to the product stream.

Provided also in this invention are processes for wrapping and securing flat packaging sleeve structures about moving product groups.

These and other benefits of this invention will become clear from the following description, by reference to the drawings.

BRIEF DEsORIPTION OF THE DRAWINGS

FIG. 8 is a lateral schematic view of the packaging sleever assembly shown in FIG. 7;

FIG. 9 is a top view of the adjustable flight bar structures shown utilized in the packaging sleever assembly of FIG. 7;

FIG. 10 is a perspective view of the adjustable flight bar structures shown in FIG. 7

FIG. 11 is a cross sectional view of the flight bar structure and taken along lines 11—11 of FIG. 9;

DESCRIPTION OF THE PREFERRED EMBODIMENT

Figure 1:
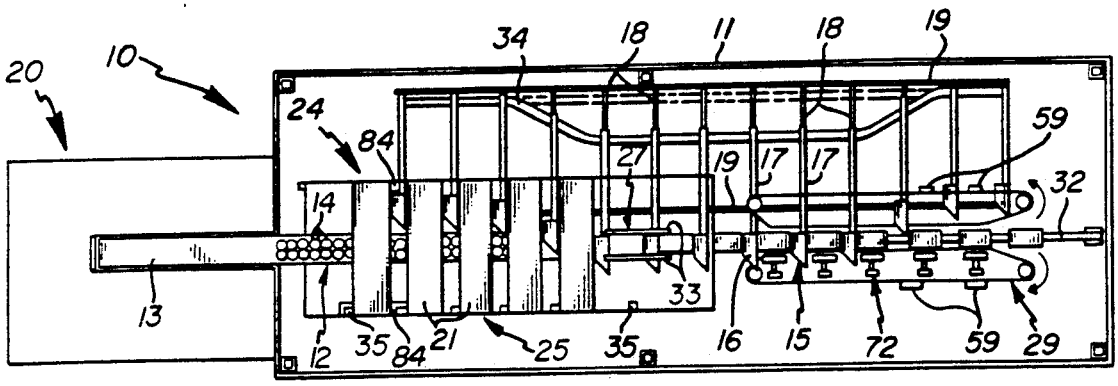
FIG. 1 is a top view of the packaging sleever assembly of this invention shown in use with cooperating and associated packaging equipment.
Figure 2:
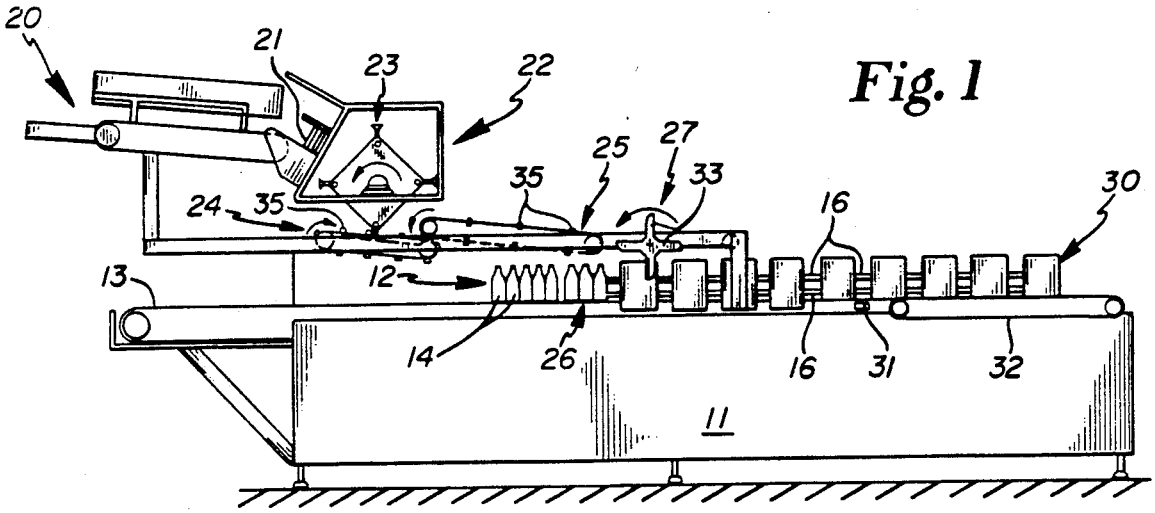
FIG. 2 is a lateral schematic view of the packaging sleever assembly shown in FIG. 1.

Referring to FIGS. 1 and 2, a packaging sleever assembly 10 is shown having a frame structure 11 and a product stream 12 which is moved on an infeed conveyor 13. The product stream 12 is comprised of a plurality of individual products 14, such as cans, bottles or the like. The infeed conveyor 13 moves the individual products 14 through the packaging sleever assembly structure 10.

A plurality of flight bar structures 15 are provided to move along with and horizontally into the product stream 12 and to separate the product stream into product groups 26, such as six container groupings. For purposes of this invention, any number of individual products can comprise a product group, including a single product. The positioning and movement of the flight bar structures 15 is determined by the movement of a cam roller structure attached to each flight bar structure 15 and which moves within the cam track or rail structure 34, as will be further described. The flight bar structure 15 is comprised of an elongated shaft 17 having a leading end 16. The leading end 16 is shown to be of a slanted construction to wedge into the product stream 12 and to separate individual products 14 into product groupings 26. The elongated shafts or bars 17 are supported on slide shafts 18 which are mounted for continuous movement, in the product flow direction, on driven opposing chains 19. The resultant movement of the shafts 17 on slide bars 18 is generally perpendicular with respect to that of the horizontal product flow. The flight bar structures 15 contain and transport the product groups 26 and packaging sleeves 21 through the sleever assembly. The conveyor 13 preferably moves slightly faster than the flight bar structures.

As shown in FIGS. 3–6, the flight bar structures 15 are movable in the product stream direction as well as in the direction perpendicular to the product stream. The support and slide shafts 18 are shown mounted to and between the parallel chains 19. A sliding block 37 having apertures therethrough for slidingly receiving the shafts 18 has the elongated shaft or bar structure 17 mounted thereto. Linear bearings, as known in the art, are located within the sliding blocks 37 to provide smooth sliding motion of the flight bar structure 15 as the cam roller mounted on the bottom of the block 36 is moved in the cam track structure 34. The latter configuration provides perpendicular motion of the flight bars 15, as well be further described.

Figure 3:
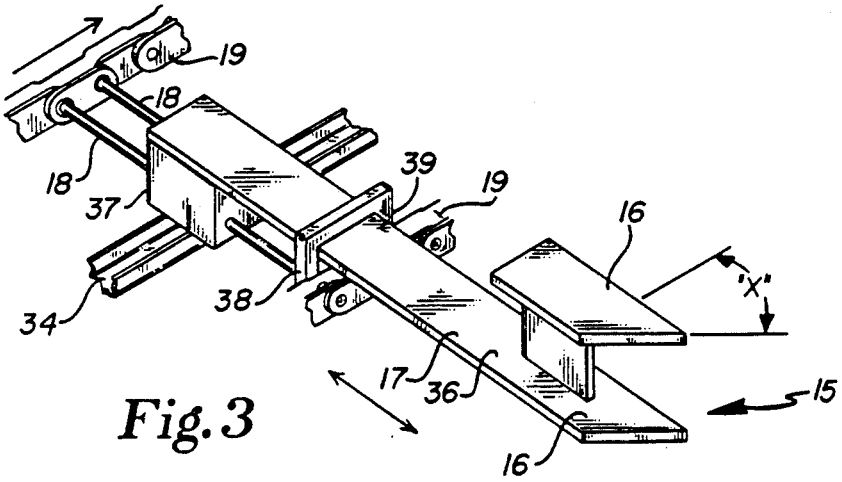
FIG. 3 is a perspective view of the flight bar structures of the assembly shown in FIGS. 1 and 2.
Figure 4:
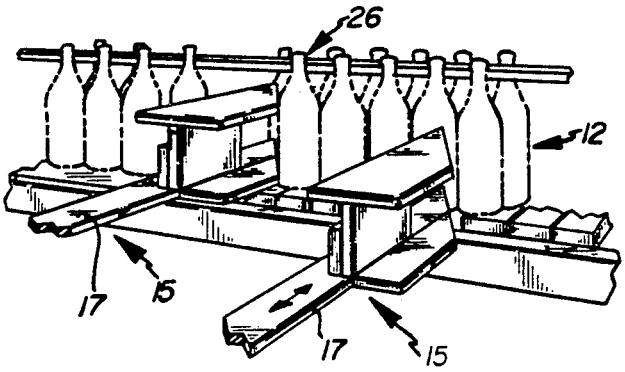
FIGS. 4–6 are views of the flight bar structures of FIG. 3 shown in successive process positions in the assembly of FIGs. 1 and 2.
Figure 5:
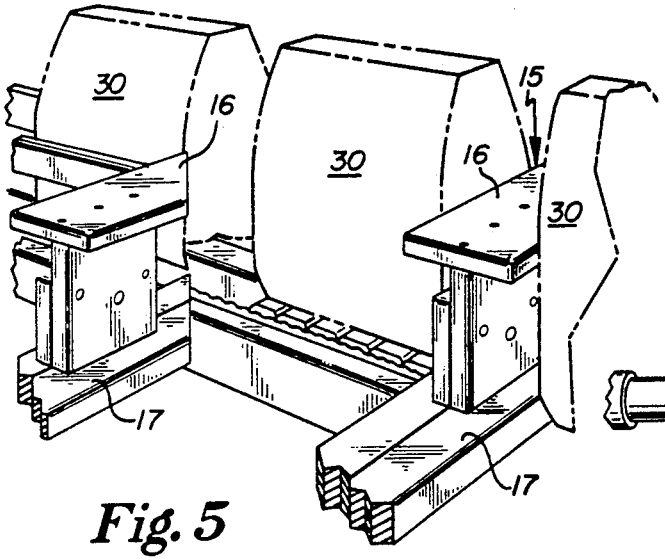

Further shown in FIG. 3, are guide blocks 38 which are mounted to one chain 19. The guide blocks 38 have slide apertures 39 which slidingly receive the shaft members 17 and which provide stability for the flight bar structures 15. At the terminal or leading ends 16 of the flight bar structures 15, an angled surface "X" is provided to wedge between the individual products 14 to form product groups 26. Although an angle range of 10–80 degrees can be utilized depending upon product size, configuration and structure, an angle of approximately 45 degrees has been found suitable for most applications, particularly for cylindrical containers, such as bottles, cans and the like. As shown, a vertical extension structure 36 is mounted to the shaft member 17 to provide an upper spacially parallel angled leading edge 16 to yield a double faced wedge structure to provide further stability to the products being selected and moved.

As further shown in FIGS. 1 and 2, a storage magazine 20, such as a powered magazine, is provided having a supply of packaging sleeves 21 which are in a flat configuration. In cooperation with the storage magazine 20, a sleeve transfer device 22 is provided having a plurality of sleeve transfer mechanisms 23 which remove the individual sleeves 21 from the storage magazine 20. The packaging sleeves usable in the assemblies and processes of this invention include carton, cardboard, corrugated, laminated and semi-rigid or stiff packaging structures. The sleeve transfer mechanisms as described in U.S. Pat. Nos. 4,530,686 and 4,802,324 can operate via a vacuum system to place the individual sleeves 21 in synchronized movement onto sleeve transfer means for movement directly above and in synchronization with the movement of the product groups 26. As discussed, the various elements of the sleever assembly are synchronized for operation by means of common or timed individual drive means as discussed further for example in U.S. Pat. No. 4,802,324.

Figure 7:
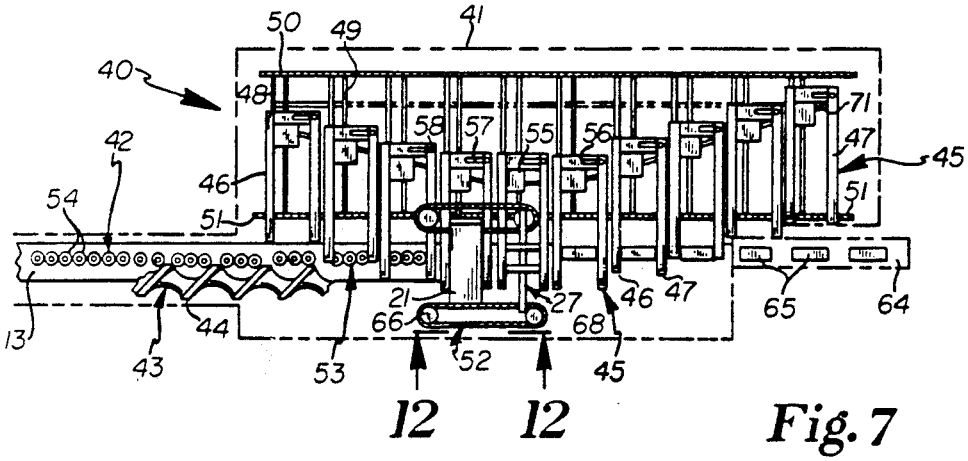
FIG. 7 is a top view of another embodiment of the packaging sleever assembly and shown in use with alternate cooperating packaging equipment.

The packaging sleever assembly 10 (and 40) has a sleeve placement structure 24 and 25 (and 52), an embodiment of which is shown in FIGS. 1 and 2 (and in FIGS. 7 and 8). Bottom sleeve transfer chain flights 24 and top transfer flights 25, as shown in FIG. 2, are provided with lugs and cooperating support structure to move the individual sleeves in synchronization above the leading ends 16 of the flight bar structures 15. The bottom and top sleeve transfer belt structures 24 and 25 further have opposing support plates 84 to receive the sleeves 21 and to permit the lugs 35 to transport or push the sleeves 21 thereon. The elongated support plates 84 can be grooved channel members, for example.

Additionally, a rotary tucker mechanism 27 is shown engaging the sleeves 21. The mechanism 27 is comprised of parallel wheel structures having vanes 33 which push the flat sleeve structures 21 from the top transfer flights 25 and fold the sleeves 21 along the sides and downward the product groups 26 in succession as each wheel vane or blade 33 is synchronized to move between the moving flight shafts 17. The flight bar structures 15 then simultaneously further transfer the folded sleeve structures 28 and the associated product groups 26. A side compression closing flight structure 29 is shown in use with an opposing structure to close the partially constructed sleeve configuration 28 to permit the sealing and locking of the sleeve bottom portion to form the closed sleeve structure 30. To ensure that the sleeve structures are wrapped tightly about the product groups, as will be further described with respect to FIGS. 14 and 15, the side compression closing flight structure 29 has pneumatically or like pressure controlled chain support rail sections.

An adhesive applicator 31 is further shown provided to seal the sleeve structures to yield the wrapped configuration. Alternatively, other sleeve closing mechanisms can be provided to result in the closed sleeve product group 30. For example, the flat sleeve configuration 21 can be provided to have bottom locking structures.

FIGS. 7 and 8 show an embodiment 40 of the packaging sleever assembly of this invention. The packaging sleever assembly 40 has a frame structure 41 which is in alignment to receive product stream 42 on infeed conveyor 13. The product stream 42 is comprised of individual product units 54 which are shown selected into product groups 53 by means of an infeed screw 43. The infeed or timing screw 43 has a plurality of flights 44 which are spaced at predetermined intervals to yield the product groups 53. Other product selecting mechanisms to group products known in the art, such as star wheels or timed selector belts, may also be utilized in accordance with the teachings of this invention.

The sleever assembly 40 is shown to have a plurality of flight bar assemblies 45 which move in synchronization with the product stream, but which also move perpendicularly into the product stream. The flight bar assemblies are comprised of flight bar structures 46 and 47 which move the product groups and which subsequently receive the flat sleeve structures, thereabove, as will be further described. The flight bar assemblies 45 move on support and slide shafts 48 and 49 which are connected for movement with opposing continuous chains 50 and 51.

As further shown in FIG. 8, a sleeve transfer device 22 having a plurality of sleeve transfer mechanisms 23 is provided to remove individual sleeves 21 in a flat configuration from a sleeve storage structure 60. The sleeve storage structure 60 shown is a gravity feed magazine which allows the sleeves to be removed by the vacuum cups, for example, of the sleeve transfer mechanisms 23 and deposited onto the sleeve transfer structure 52 above the product groups 53, as will be further described with respect to FIGS. 12 and 13.

As shown in FIGS. 9, 10 and 11, the flight bar assemblies 45 are connected to opposing continuous chains 50 and 51. The support and slide shafts 48 and 49 are directly attached to and between the links of the continuous chains 50 and 51. A sliding block structure 55 is provided to slide on the support shafts 48 and 49 and to which the flight bars 46 and 47 are also connected. The slide blocks 55 each have a cam roller structure 70 attached underneath to engage the cam rail structure 71 to control the perpendicular movement of the slide bar assemblies 45. As shown in FIGS. 1, 3, 7 and 9–11, the cam rail structures 34 and 7 have a predetermined configuration with sloped portions to position the flight bar structures 15 and flight bar assemblies 45 at predetermined locations with respect to the remaining cooperating elements of the packaging sleever assemblies.

The flight bar assemblies 45 are further shown to have a fixed flight bar member 46 mounted to sliding block 55. A support member 56 is shown having an adjustment slot 57 which permits the flight bar 47 to be adjustably positioned with respect thereto. Thus, the flight bar assemblies 45 are adjustable structures that permit the parallel flight bars 46 and 47 to be spaced in accordance with the product dimensions 54 and, particularly, to compensate for the dimensions of the product group 53.

Figure 12:
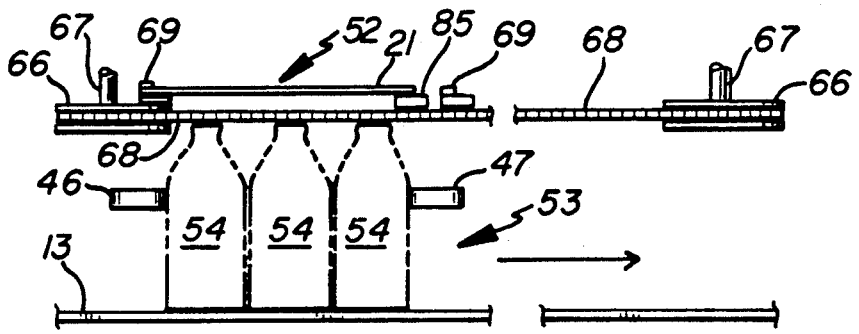
FIG. 12 is a lateral view taken along lines 12—12 of FIG. 7 and showing the sleeve transfer structure with a packaging sleeve placed thereon above a moving product group.
Figure 13:
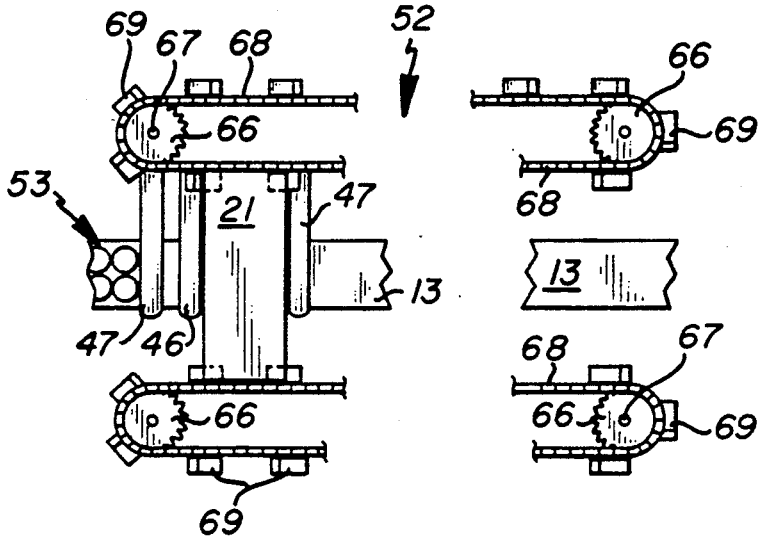
FIG. 13 is a top view of the sleeve transfer structure shown in FIG. 12.

As shown further in FIGS. 12 and 13, the flight bars 46 and 47 have the sleeve transfer structure 52 mounted and being operative thereabove. The sleeve transfer structure 52 is comprised of driven gears 66 mounted for rotation on shafts 67. Lugs 69 are spaced and connected to the continuous chains 68 to thereby support the flat sleeve 21 which spans across the conveyor !3. The lugs 69 are preferably formed lugs with platform and backwall portions to hold and push the sleeves as the chains or belts are rotated. Non-formed or flat lugs are also provided to alternately support the sleeves 21 thereon. The sleeve transfer structure 52 is positioned so that the sleeve structures 21 rest on the formed lugs 69 and the flat lugs of chain 68 and are moved in synchronization along with the movement of the flight bar assemblies 45. As shown in FIG. 8, as the product group 53 is moved with the sleeve 21 positioned thereabove, a rotary tucker 27, as previously described, folds the sides of the sleeve structures to yield a side folded sleeve configuration 61. As shown, the vanes 33 of the rotary tucker 27 may have rounded corners to engage the sleeves, as known in the art. Thereafter, a guide bar or plow structure 62 is provided to tuck the bottom of the cartons underneath the product groups 53. Thereafter, a glue station or a sleever lock station having a compression chain assembly, as further described with respect to FIGS. 14 and 15, is utilized to secure the sleeve structure about the product group to yield the wrapped product structure 65 which is removed from the sleever assembly by means of the end user's conveyor 64.

Figure 6:
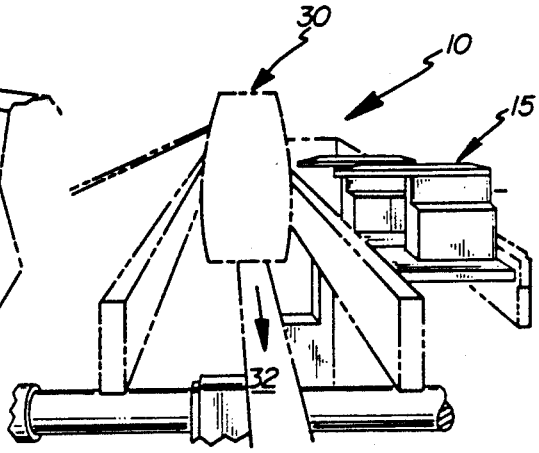

As shown in FIGS. 1, 2 and 6 and in FIGS. 7 and 8, discharge conveyors 32 and 64, respectively, are utilized to remove the closed sleeves or wrapped products 30 and 65 from the sleever assemblies 10 and 40, respectively. These discharge conveyors are shown positioned in line with the infeed conveyors 13 which transport the product streams through the respective sleever assemblies 10 and 40. The discharge conveyors 32 and 64 are shown to operate along the path generally to where the respective flight bar assemblies 15 and 46, 47 are retracted from the packaged product stream. The discharge conveyors 32 and 64 may be supplied as part of the assemblies 10 and 40 or may be supplied at the bottler or packaging facility to provide a stream of packaged products.

Figure 14:
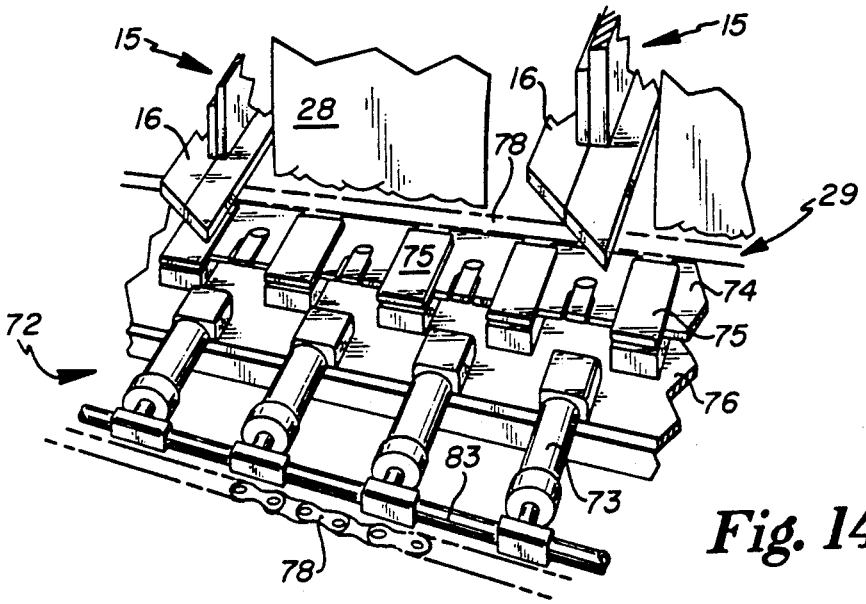
FIGS. 14 and 15 are views of the side compression closing flight structure shown in FIG. 1.
Figure 15:
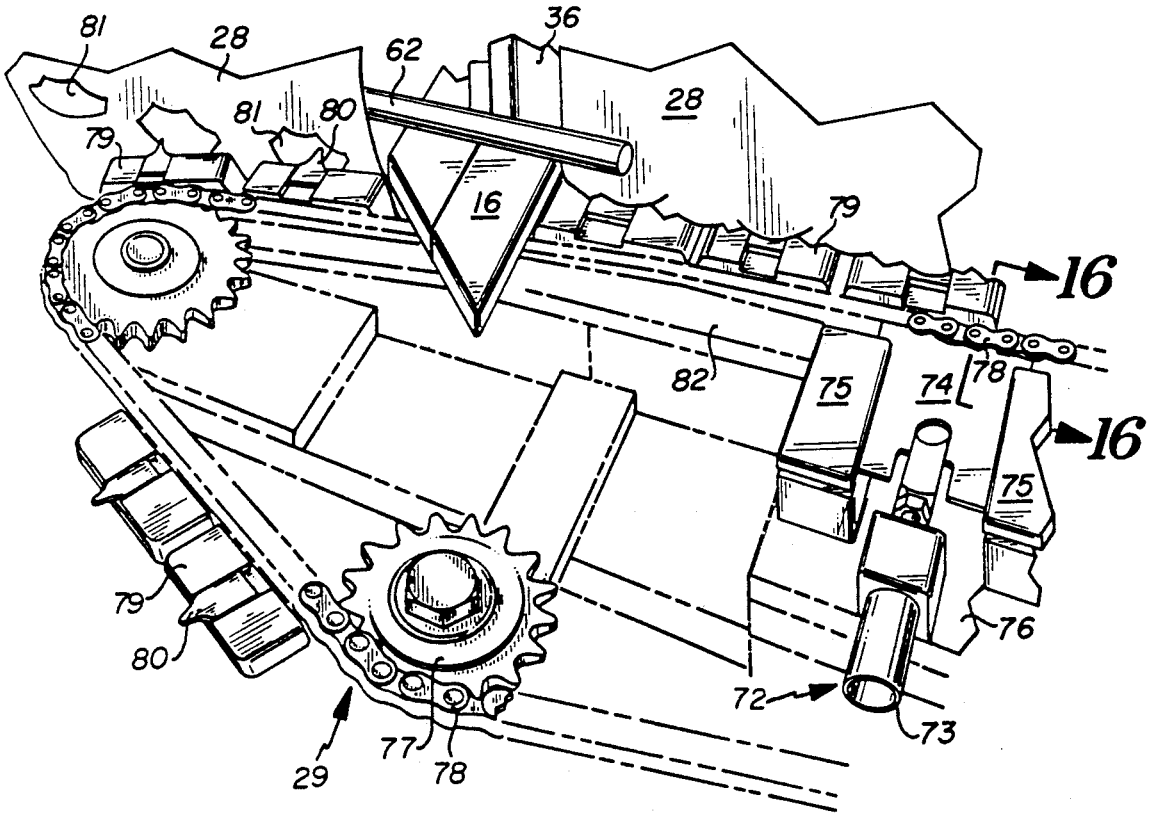

FIGS. 14 and 15 show further detail of the side compression closing flight structure 29 shown in FIG. This sleever closing structure 29 can also be used with the other embodiments discussed above and shown in the drawings. FIGS. 1 and 14 show a plurality of chain rail support structures 72 used in the sleever closing structure 29 which work in cooperation with the opposing closing structure which may have a continuous rigid chain support rail mounted adjacent its lugged chain, as known in the art.

The chain rail support structures 72 are pressure controlled units which provide segmented flexible pressure control on the chain 78. The gear driven chain 78 has closing flight structures 79 with outwardly extending compression tabs 80 which are utilized in the art to engage the compression slots 81 in sleeves 28. The slots 81 provide means to grasp opposing sides of the sleeve structures so that a tight wrap about the product group is attained as the overlapping bottom portions of the packaging sleeve are secured or sealed together, for example. The pressure control or flexible chain support structures 72 have pneumatic cylinders 73 or like pressure control structures in connection with chain pressure blocks 74 along which the chain 78 moves. The steel plate blocks 74, for example, are further shown slidingly secured in slide tracks of bearing blocks 75 constructed of nylon, for example, and which are mounted to frame structure 76. The pneumatic cylinders, or the like, provide a controlled pressure via an air supply 83, for example, so that product size variations can be compensated for by tightly wrapping the packaging sleeve 28 about the product group. The pressure is controlled below a point where damage is caused to the packaging structure.

Figure 16:
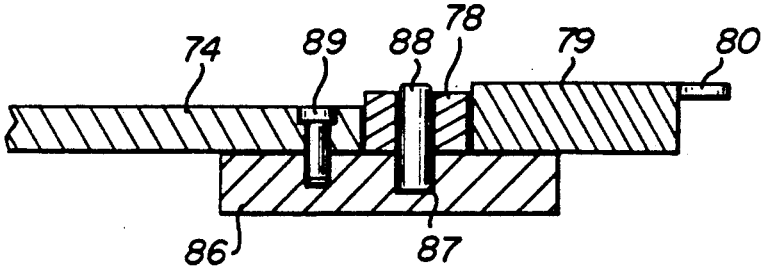
FIG. 16 is a cross section taken along lines 16—16 of FIG. 15.

FIG. 16 shows the chain pressure block 74 to have a support block 86 attached beneath it via fasteners 89. The support block 86 has a channel 87 therethrough to receive the elongated chain pins 88 that extend through chain 78. This arrangement prevents the closing flights 79 from rising upward as the slots 81 of the sleeves 28 are engaged. Preferably, each chain pressure block 74 has such a support block 86 attached thereto. The extended pins 88 are preferably located at each closing flight 79 location and a plurality of such pins 88 are usually present to ensure horizontal movement of the closing flights 79.

In operation, the packaging sleever assembly selects product groups from a product stream. A sleeve transfer device removes individual sleeve structures onto a sleeve transport device which is synchronized with the product group movement. The flights of the product group movement structures move the products groups below the sleeve transport device. A rotary tucker structure move the sleeves downward onto the product groups. Thereafter, the flights contain and move the product groups and sleeves simultaneously through the sleeve wrapping and closing structure to provide packaged product groups.

As many changes are possible to the embodiments of this invention, utilizing the teachings thereof, the description above and the accompanying drawings sould be interpreted in the illustrative and not the limited sense.

What is claimed is:

1. A packaging sleever assembly for placing sleeves onto and about selected product groups being moved on a conveyor in a packaging operation comprising:

(a) a frame structure having a generally horizontal working area and having a conveyor means for transporting a product stream through said working area, (b) a sleeve transfer device for removign individual sleeves from a sleeve supply and for moving the sleeves at a predetermined rate to a predetermined location above said conveyor means, (c) a continuous product group selecting and moving assembly having selecting and moving structures spaced at predetermined distances, said selecting and moving structures comprising a pair of parallel continuous chains having slidable flight bar structures mounted thereot and being constructed and arranged to perpendicularly engage between individual products of the prodcut stream to select product groups, to move selected product groups in synchronization with said sleeve transfer device and to hold the sleeves for movement with the selected product groups, said selecting and moving structures further comprising a pair of parallel slide shafts which are connected at each end thereof to one of said chains, a sliding block mounted to each said flight bar structure and slidably to said slide shafts via apertures therein, said sliding block further having a cam roller mounted thereto, said frame structure further having a cam track with sloping portions mounted thereto for reception of said cam roller to provide said perpendicular movement of said flight bar structures, (d) a sleeve placement structure for engaging and moving said sleeves from said sleeve transfer device onto the selected product groups at said predetermined location above said conveyor means along said conveyance path, said sleeve placement structure being synchronized with said selecting and moving structures, and (e) a sleeve wrapping and closing structure in synchronized movement with said product group selecting and moving structures.

2. The packaging sleever assembly of claim 1, wherein said slidable flight bar structures have angled terminal ends having a predetermined slope.

3. The packaging sleever assembly of claim 1, wherein said assembly has an infeed grouping mechanism for providing selected product groups and wherein said selectign and moving structures are comprised of continuous motion flight bar assemblies having flight bars slidably engaged on a support structure, said support structure comprising elongated shafts mounted to parallel continuous chains.

4. The packaging sleever assembly of claim 1, wherein said sleeve placement structure further comprises a rotary flap tucker mechanism comprised of spaced rotating vanes disposed above and on opposite sides of said product stream.

5. The packaging sleever. assembly of claim 1, wherein said sleeve wrapping and closing structure includes a side compression closing flight structure placed lateral said product stream for engaging the sleeves, said structure having pressure control means.

6. The packaging sleever assembly of claim 5, wherein said side compression closing flight structure further has segmented chain support rails and a continuous lugged chain structure and wherein said pressure control means are pneumatic cylinders connected to said segmented chain support rails.

7. The packaging sleever assembly of claim 1, wherein said sleeve transfer device is comprised of a rotary placer device having at least one sleeve transfer mechanism.

8. The packaging sleeve assembly of claim 1, wherein said sleeve placement structure is mounted above said product group selecting and moving structures and is operative to receive sleeves from said sleeve transfer device.

9. A continuous pacakging sleever assembly for wrapping packaging sleeves onto and about groupings of product containers in a packaging operation comprising:

(a) a frame structure having a generally horizontal working surface area;

(b) conveyance means to move the product containers across said working surface;

(c) a horizontally movable flight bar assembly having a plurality of flight bars connected to continuous means and having a continuous conveyance path through the packaging operation, said flight bar assembly being constructed and arranged to be selectively movable in a generally perpendicular direction to said product conveyance means and to separate the product containers into predetermined groups;

(d) a packaging sleeve placement structure in synchronization with said flight bar assembly and for depositing packaging sleeves between anda bove said flight bars of said flight bar assembly and above the product groups; and (e) means to wrap and close said packaging sleeves about the product groups, said means to wrap and close including a side compression closing flight structure having segmented chain support rails, a continuous lugged chain structure, and pressure cotnrol means connected to said segmented chain support rails and being operative on said packaging sleeves.

10. The sleever assembly of claim 9, wherein an infeed section is provided in alignment with said conveyance means and wherein an outfeed section is provided in alignment with said conveyance means.

11. The sleever assembly of claim 9, wherein said flight bar assembly is comprised of a pair of continuous chains having slidable flight bar structures mounted thereto and being constructed and arranged to engage between individual products to select product groups.

12. The sleeve assembly of claim 9, further comprising a product selector mechanism for providing selected product grups, and wherein said flight bar assembly has adjustable flight bars slidably engaged on a support structure, said support structure comprising elongated shafts mounted to parallel continuous chains.

13. The sleever assembly of claim 9, wherein said wrapping means includes a rotary flap tucker to engage the sleeves moved above the product groups and wherein said rotary flap tucker mechanism is comprised of spaced rotating vanes disposed above and on opposite sides of said product stream.

14. A process for wrapping and securing flat packaging sleeve structures about movign selected product groups comprising:

(a) moving a stream of individual products, (b) selecting predetermined product groups from said stream, (c) providing a supply of flat packaging sleeves, (d) moving and placing individual sleeves from said packaging sleeve supply above said selected product groups and in synchronized movement therewith, and (e) lowering, wrapping and sealing said individual sleeves onto and about said selected product groups via a packaging sleever assembly having a frame, a sleeve transfer device, a continuous cam track structure having sloping sections, and a continuous product group movement structure controlled via said cam track structure for moving said selected product groups, said product group movement structure including parallel chains having slidable flight bar structures mounted thereto via slide shafts connected to said chains and sliding blocks mounted to said flight bar structures and slidably engaging said slide shafts, and sliding said sliding blocks along said slide shafts to move said flight bars horizontally with and perpendicularly to said product stream and to move selected product groups in synchronization with said sleeve transfer device.

15. The process of claim 14, wherein said packaging sleever assembly is provided with a product group selecting structure constructed and arranged to select said predetermined product groups on said line conveyor.

16. The process of claim 14, wherein said continuous product group movement structure is constructed and arranged to have means for selecting the predetermined product groups on said line conveyor.

17. The process of claim 14, wherein said packaging sleever assembly is provided with a sleeve movement device constructed and arranged in synchronized placement with said sleeve transfer device and said product group movement structure and being for placing and moving said individual sleeves above said moving selected product groups.

18. The process of claim 17, wherein said sleeve placement device further comprises a rotary tucker structure for lowering and wrapping said individual sleeves onto and about said selected product groups.

19. The process of claim 14, wherein said sleeve transfer device is comprised of a rotary transfer device having at least one article transfer mechanisms.

20. The process of claim 14, wherein said sleever assembly further has a side compression closing flight structure having pressure control means for wrapping and sealing said individual sleeves.

21. A packaging sleever assembly for placing sleeves onto and about selected product grups being moved on a conveyor in a packaging operation comprising:

(a) a frame structure having a generally horizontal working area and having a conveyor means for transporting a product stream through said working area, (b) a sleeve transfer device for removing individual sleeves from a sleeve supply and for moving the sleeves at a predetermined rate to a predetermined location above said conveyor means, (c) a continuous product group selecting and movign assembly having a continuous conveyance path through the packaging operation and having a plurality of selecting and moving structures spaced at predetermined distances, said selecting and moving structures being constructed and arranged to move horizontally with and perpendicularly to said product stream and to move selected product groups in synchronization with said sleeve transfer device and to hold the sleeves between adjacent selecting and moving structures for movement with the selected product groups, (d) a sleeve placement structure for engaging and moving said sleeves from said sleeve transfer device onto the selected product groups at said predetermined location above said conveyor means along said conveyance path, said sleeve placement structure being synchronized with said selecting and moving structures, and (e) a side compression closing flight structure placed lateral said product stream for engaging the sleeves, said side compression closing flight structure having segmented chain support rails, a continuous lugged chain structure and pneumatic cylinders connected to said segmented chain support rails.

* * * * *